US009086026B2

(12) United States Patent
Levijoki et al.

(10) Patent No.: US 9,086,026 B2
(45) Date of Patent: Jul. 21, 2015

(54) SYSTEM AND METHOD FOR CONTROLLING TORQUE OUTPUT OF AN ENGINE WHEN A WATER PUMP COUPLED TO THE ENGINE IS SWITCHED ON OR OFF

(71) Applicant: GM GLOBAL TECHNOLOGY OPERATIONS LLC, Detroit, MI (US)

(72) Inventors: Stephen Paul Levijoki, Swartz Creek, MI (US); Christopher Harold Knieper, Chesaning, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 202 days.

(21) Appl. No.: 13/713,805

(22) Filed: Dec. 13, 2012

(65) Prior Publication Data

US 2014/0172273 A1 Jun. 19, 2014

(51) Int. Cl.

| | |
|---|---|
| ***F02M 3/00*** | (2006.01) |
| ***F02D 11/10*** | (2006.01) |
| ***F02D 41/08*** | (2006.01) |
| ***F02D 41/04*** | (2006.01) |
| ***F02D 41/14*** | (2006.01) |
| *F02P 5/15* | (2006.01) |

(52) U.S. Cl.

CPC ..... *F02D 41/083* (2013.01); *F02D 41/04* (2013.01); *F02D 41/08* (2013.01); *F02D 41/1497* (2013.01); *F02D 2250/22* (2013.01); *F02P 5/1504* (2013.01)

(58) Field of Classification Search

CPC ..... F02P 5/1504; F02P 5/1512; F02D 41/04; F02D 41/08; F02D 41/083

USPC ..... 701/110, 103, 102; 123/339.11, 41.44, 123/41.02, 41.07, 436, 399, 568.11, 406.23, 123/406.24, 406.52, 198 C

See application file for complete search history.

(56) References Cited

U.S. PATENT DOCUMENTS

| | | | | | |
|---|---|---|---|---|---|
| 4,582,032 | A * | 4/1986 | Hara et al. | ..... | 123/339.11 |
| 4,732,125 | A * | 3/1988 | Takizawa | ..... | 123/406.19 |
| 4,915,076 | A * | 4/1990 | Takizawa | ..... | 123/406.19 |
| 5,163,399 | A * | 11/1992 | Bolander et al. | ..... | 123/339.17 |
| 5,390,632 | A * | 2/1995 | Ikebe et al. | ..... | 123/41.02 |
| 5,623,906 | A * | 4/1997 | Storhok | ..... | 123/406.23 |
| 5,662,084 | A * | 9/1997 | Deguchi et al. | ..... | 123/339.11 |
| 5,666,917 | A * | 9/1997 | Fraser et al. | ..... | 123/339.11 |
| 5,740,045 | A * | 4/1998 | Livshiz et al. | ..... | 701/101 |
| 6,226,585 | B1 * | 5/2001 | Cullen | ..... | 701/54 |
| 6,379,283 | B1 * | 4/2002 | Cullen | ..... | 477/110 |
| 6,668,766 | B1 * | 12/2003 | Liederman et al. | ..... | 123/41.44 |
| 6,688,282 | B1 * | 2/2004 | Okubo et al. | ..... | 123/339.11 |
| 6,796,288 | B2 * | 9/2004 | Franke et al. | ..... | 123/406.35 |
| 6,895,928 | B2 * | 5/2005 | Shepperson | ..... | 123/339.11 |
| 8,560,204 | B2 * | 10/2013 | Simon et al. | ..... | 701/102 |

(Continued)

*Primary Examiner* — Lindsay Low
*Assistant Examiner* — George Jin

(57) ABSTRACT

A system according to the principles of the present disclosure includes a pump control module, an actuator control module, and a torque reserve module. The pump control module switches a water pump between on and off. The water pump circulates coolant through an engine when the water pump is on. The actuator control module controls a first actuator of the engine based on a first torque request and that controls a second actuator of the engine based on a second torque request. The torque reserve module adjusts a torque reserve before the water pump is switched on or off based on a change in engine load expected when the water pump is switched on or off. The torque reserve is a difference between the first torque request and the second torque request.

20 Claims, 5 Drawing Sheets

(56) References Cited

U.S. PATENT DOCUMENTS

| | | | | |
|---|---|---|---|---|
| 8,594,904 | B2 * | 11/2013 | Livshiz et al. | 701/102 |
| 2005/0061263 | A1 * | 3/2005 | Lee | 123/41.1 |
| 2005/0205063 | A1 * | 9/2005 | Kolmanovsky et al. | 123/436 |
| 2006/0102143 | A1 * | 5/2006 | Yagi | 123/339.11 |
| 2009/0241899 | A1 * | 10/2009 | Whitney et al. | 123/406.45 |
| 2009/0276130 | A1 * | 11/2009 | Whitney et al. | 701/68 |
| 2010/0057325 | A1 * | 3/2010 | Livshiz et al. | 701/102 |
| 2010/0268436 | A1 * | 10/2010 | Soejima et al. | 701/102 |
| 2011/0195817 | A1 * | 8/2011 | Whitney et al. | 477/121 |
| 2011/0276256 | A1 * | 11/2011 | Kociba et al. | 701/110 |
| 2012/0234123 | A1 * | 9/2012 | Whitney et al. | 74/473.1 |

* cited by examiner

SYSTEM AND METHOD FOR CONTROLLING TORQUE OUTPUT OF AN ENGINE WHEN A WATER PUMP COUPLED TO THE ENGINE IS SWITCHED ON OR OFF

FIELD

The present disclosure relates to systems and methods for controlling torque output of an engine when a water pump coupled to the engine is switched on or off.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Engine water pumps are typically belt-driven centrifugal pumps that circulate coolant through an engine to cool the engine. Coolant is received through an inlet located near the center of a pump, and an impeller in the pump forces the coolant to the outside of the pump. Coolant is received from a radiator, and coolant exiting the pump flows through an engine block and a cylinder head before returning to the radiator.

In a conventional water pump, the impeller is always engaged with a belt-driven pulley. Thus, the pump circulates coolant through the engine whenever the engine is running. In contrast, a switchable water pump includes a clutch that engages and disengages the impeller to switch the pump on and off, respectively. The pump may be switched off to reduce the time required to warm the engine at startup and/or to improve fuel economy, and the pump may be switched on to cool the engine.

SUMMARY

A system according to the principles of the present disclosure includes a pump control module, an actuator control module, and a torque reserve module. The pump control module switches a water pump between on and off. The water pump circulates coolant through an engine when the water pump is on. The actuator control module controls a first actuator of the engine based on a first torque request and that controls a second actuator of the engine based on a second torque request. The torque reserve module adjusts a torque reserve before the water pump is switched on or off based on a change in engine load expected when the water pump is switched on or off. The torque reserve is a difference between the first torque request and the second torque request.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

A control system and method may switch a water pump on or off based on cooling demands of an engine. The water pump may be switched on to cool the engine. The water pump may be switched off to reduce the time required to warm the engine at startup and/or to improve fuel economy. When the water pump is switched on, the speed of the engine may decrease due to an increase in engine load. When the water pump is switched off, the engine speed may increase due to a decrease in engine load.

A control system and method according to the principles of the present disclosure adjusts the torque output of an engine using a fast engine actuator when a water pump is switched on or off to compensate for a resulting change in engine load. This prevents an abrupt change in engine speed when the water pump is switched on or off. Adjusting the torque output of the engine using a fast engine actuator instead of a slow engine actuator avoids delays associated with adjusting slow engine actuators.

Slow engine actuators may be controlled based on a predicted torque request and fast engine actuators may be controlled based on an immediate torque request. In a spark-ignition engine, a spark plug may be a fast engine actuator and a throttle valve may be a slow engine actuator. In a compression-ignition engine, a fuel injector may be a fast engine actuator and actuators that influence intake airflow, such as a boost device and an exhaust gas recirculation (EGR) valve, may be slow engine actuators.

A torque reserve is adjusted before the water pump is switched on or off so that the torque output of the engine may be adjusted using the fast engine actuator. The torque reserve is a difference between the predicted torque request and the immediate torque request. The torque reserve may be increased before the water pump is switched on. Then, when the water pump is switched on, the fast engine actuator may be adjusted to prevent a decrease in engine speed due to switching on the water pump. The torque reserve may be decreased before the water pump is switched off. Then, when the water pump is switched off, the fast engine actuator may be adjusted to prevent an increase in engine speed due to switching off the water pump.

Figure 1:
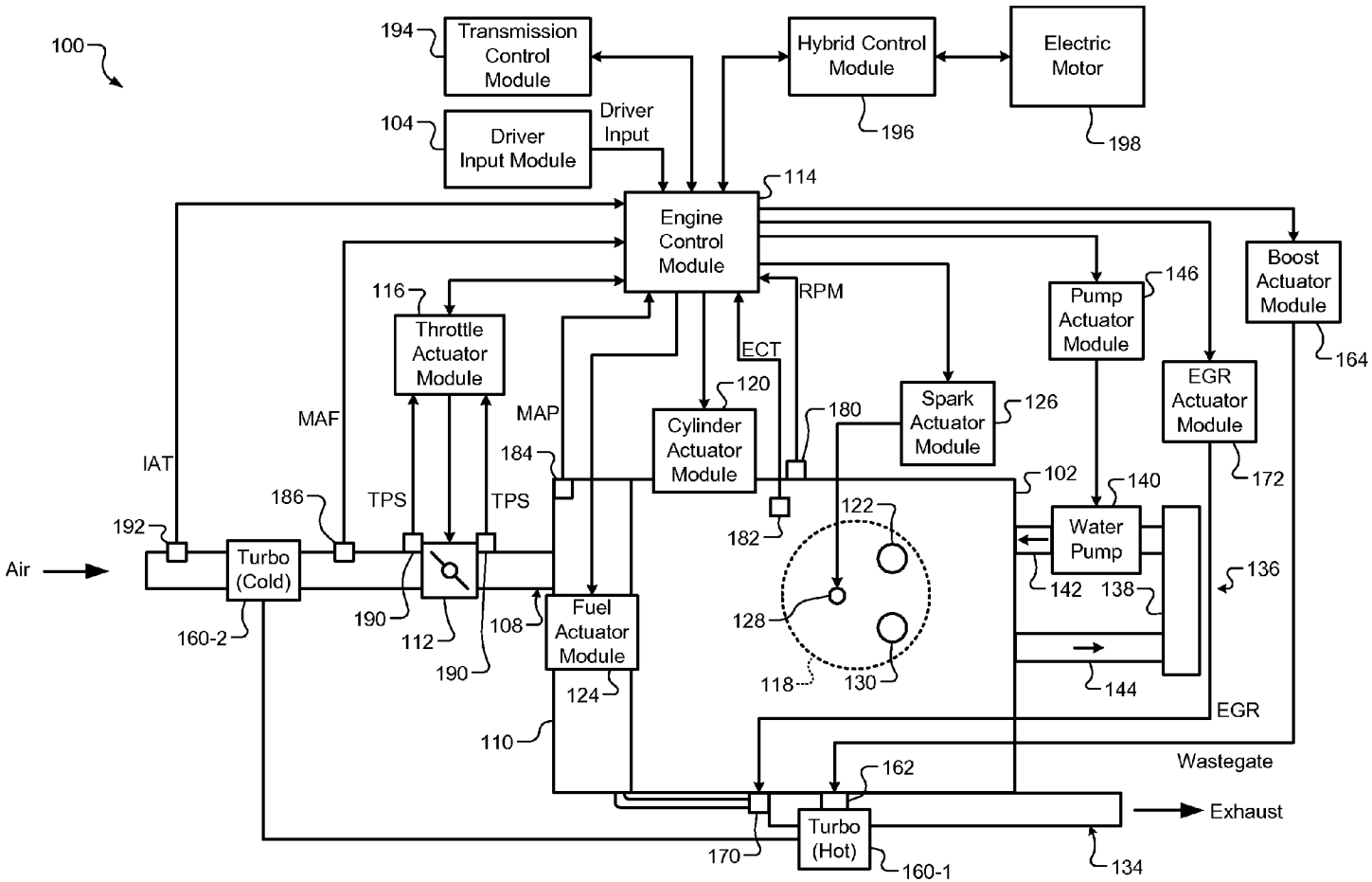
FIG. 1 is a functional block diagram of an example engine system according to the principles of the present disclosure.

Referring now to FIG. 1, an example implementation of an engine system 100 includes an engine 102. The engine 102 combusts an air/fuel mixture to produce drive torque for a vehicle based on driver input from a driver input module 104. Air is drawn into the engine 102 through an intake system 108. The intake system 108 includes an intake manifold 110 and a throttle valve 112. In one example, the throttle valve 112 includes a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations, fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114. In turn, the spark plug 128 generates a spark that ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, the combustion of the air/fuel mixture drives the piston down, thereby driving the crankshaft. The combustion stroke may be defined as the time between the piston reaching TDC and the time at which the piston returns to bottom dead center (BDC).

During the exhaust stroke, the piston begins moving up from BDC and expels the byproducts of combustion through an exhaust valve 130. The byproducts of combustion are exhausted from the vehicle via an exhaust system 134.

A cooling system 136 for the engine 102 includes a radiator 138 and a water pump 140. The radiator 138 cools coolant that flows through the radiator 138. The water pump 140 is a switchable water pump that circulates coolant through the engine 102 and the radiator 138 when the water pump 140 is switched on. Coolant flows from the radiator 138 to the water pump 140 and from the water pump 140 to the engine 102 through an inlet hose 142. Coolant flows from the engine 102 back to the radiator 120 through an outlet hose 144. A pump actuator module 146 switches the water pump 140 on or off based on instructions received from the ECM 114.

In one example, the water pump 140 is an electric pump. In another example, the water pump 140 is a centrifugal pump including an impeller and a clutch that selectively engages the impeller with a pulley driven by a belt connected to the crankshaft. The clutch engages the impeller with the pulley and disengages the impeller from the pulley when the water pump 140 is switched on and off, respectively. Coolant may enter the water pump 140 through an inlet located near the center of the water pump 140, and the impeller may force the coolant radially outward to an outlet located at the outside of the water pump 140.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2, driven by the turbine 160-1, that compresses air leading into the throttle valve 112. In various implementations, a supercharger (not shown), driven by the crankshaft, may compress air from the throttle valve 112 and deliver the compressed air to the intake manifold 110.

A wastegate 162 is opened to allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. The compressed air charge may also have absorbed heat from components of the exhaust system 134. Although shown separated for purposes of illustration, the turbine 160-1 and the compressor 160-2 may be attached to each other, placing intake air in close proximity to hot exhaust.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

The engine system 100 may measure the speed of the crankshaft in revolutions per minute (RPM) using an RPM sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The ECM 114 may communicate with a hybrid control module 196 to coordinate operation of the engine 102 and an electric motor 198.

The electric motor 198 may also function as a generator, and may be used to produce electrical energy for use by vehicle electrical systems and/or for storage in a battery. In various implementations, various functions of the ECM 114, the transmission control module 194, and the hybrid control module 196 may be integrated into one or more modules.

Each system that varies an engine parameter may be referred to as an actuator that receives an actuator value. For example, the throttle actuator module 116 may be referred to as an actuator and the throttle opening area may be referred to as the actuator value. In the example of FIG. 1, the throttle actuator module 116 achieves the throttle opening area by adjusting an angle of the blade of the throttle valve 112.

Similarly, the spark actuator module 126 may be referred to as an actuator, while the corresponding actuator value may be the amount of spark advance relative to cylinder TDC. Other actuators may include the fuel actuator module 124, the boost actuator module 164, and the EGR actuator module 172. For these actuators, the actuator values may correspond to fueling rate, boost pressure, and EGR valve opening area, respectively. The ECM 114 may control actuator values in order to cause the engine 102 to generate a desired engine output torque.

Figure 2:
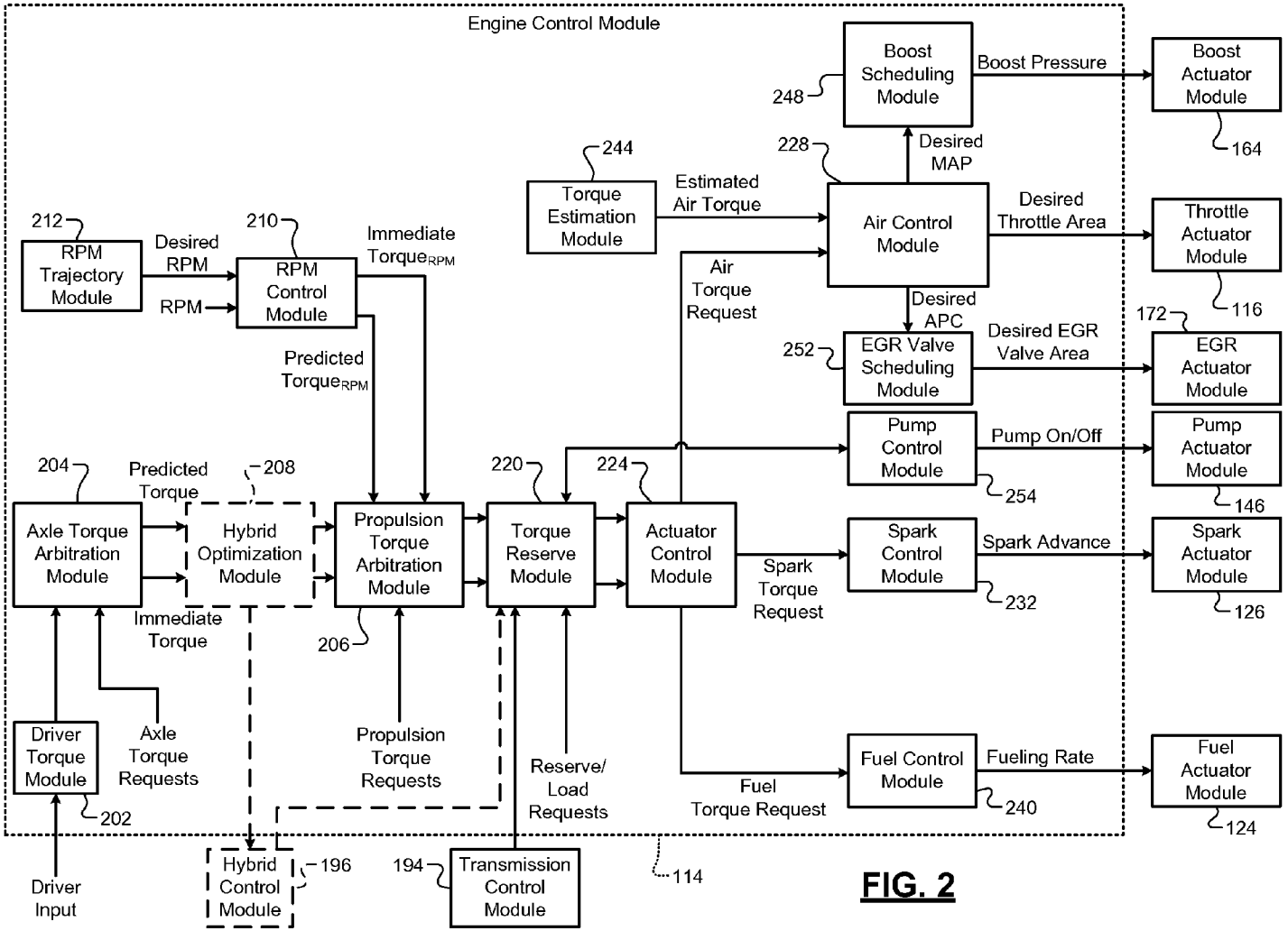
FIGS. 2 and 3 are functional block diagrams of an example control system according to the principles of the present disclosure.

Referring now to FIG. 2, an example implementation of the ECM 114 includes a driver torque module 202. The driver torque module 202 may determine a driver torque request based on a driver input from the driver input module 104. The driver input may be based on a position of an accelerator pedal. The driver input may also be based on an input from a cruise control system, which may be an adaptive cruise control system that varies vehicle speed to maintain a predetermined following distance. The driver torque module 202 may store one or more mappings of accelerator pedal position to desired torque, and may determine the driver torque request based on a selected one of the mappings.

An axle torque arbitration module 204 arbitrates between the driver torque request from the driver torque module 202 and other axle torque requests. Axle torque (torque at the wheels) may be produced by various sources including an engine and/or an electric motor. Torque requests may include absolute torque requests as well as relative torque requests and ramp requests. For example only, ramp requests may include a request to ramp torque down to a minimum engine off torque or to ramp torque up from the minimum engine off torque. Relative torque requests may include temporary or persistent torque reductions or increases.

Axle torque requests may include a torque reduction requested by a traction control system when positive wheel slip is detected. Positive wheel slip occurs when axle torque overcomes friction between the wheels and the road surface, and the wheels begin to slip against the road surface. Axle torque requests may also include a torque increase request to counteract negative wheel slip, where a tire of the vehicle slips with respect to the road surface because the axle torque is negative.

Axle torque requests may also include brake management requests and vehicle over-speed torque requests. Brake management requests may reduce axle torque to ensure that the axle torque does not exceed the ability of the brakes to hold the vehicle when the vehicle is stopped. Vehicle over-speed torque requests may reduce the axle torque to prevent the vehicle from exceeding a predetermined speed. Axle torque requests may also be generated by vehicle stability control systems.

The axle torque arbitration module 204 outputs a predicted torque request and an immediate torque request based on the results of arbitrating between the received torque requests. As described below, the predicted and immediate torque requests from the axle torque arbitration module 204 may selectively be adjusted by other modules of the ECM 114 before being used to control actuators of the engine system 100.

In general terms, the immediate torque request is the amount of currently desired axle torque, while the predicted torque request is the amount of axle torque that may be needed on short notice. The ECM 114 therefore controls the engine system 100 to produce an axle torque equal to the immediate torque request. However, different combinations of actuator values may result in the same axle torque. The ECM 114 may therefore adjust the actuator values to allow a faster transition to the predicted torque request, while still maintaining the axle torque at the immediate torque request.

In various implementations, the predicted torque request may be based on the driver torque request. The immediate torque request may be less than the predicted torque request, such as when the driver torque request is causing wheel slip on an icy surface. In such a case, a traction control system (not shown) may request a reduction via the immediate torque request, and the ECM 114 reduces the torque produced by the engine system 100 to the immediate torque request. However, the ECM 114 controls the engine system 100 so that the engine system 100 can quickly resume producing the predicted torque request once the wheel slip stops.

In general terms, the difference between the immediate torque request and the higher predicted torque request can be referred to as a torque reserve. The torque reserve may represent the amount of additional torque that the engine system 100 can begin to produce with minimal delay. Fast engine actuators are used to increase or decrease current axle torque. As described in more detail below, fast engine actuators are defined in contrast with slow engine actuators.

In various implementations, fast engine actuators are capable of varying axle torque within a range, where the range is established by the slow engine actuators. In such implementations, the upper limit of the range is the predicted torque request, while the lower limit of the range is limited by the torque capacity of the fast actuators. For example only, fast actuators may only be able to reduce axle torque by a first amount, where the first amount is a measure of the torque capacity of the fast actuators. The first amount may vary based on engine operating conditions set by the slow engine actuators. When the immediate torque request is within the range, fast engine actuators can be set to cause the axle torque to be equal to the immediate torque request. When the ECM 114 requests the predicted torque request to be output, the fast engine actuators can be controlled to vary the axle torque to the top of the range, which is the predicted torque request.

In general terms, fast engine actuators can more quickly change the axle torque when compared to slow engine actuators. Slow actuators may respond more slowly to changes in their respective actuator values than fast actuators do. For example, a slow actuator may include mechanical components that require time to move from one position to another in response to a change in actuator value. A slow actuator may also be characterized by the amount of time it takes for the axle torque to begin to change once the slow actuator begins to implement the changed actuator value. Generally, this amount of time will be longer for slow actuators than for fast actuators. In addition, even after beginning to change, the axle torque may take longer to fully respond to a change in a slow actuator.

For example only, the ECM 114 may set actuator values for slow actuators to values that would enable the engine system 100 to produce the predicted torque request if the fast actuators were set to appropriate values. Meanwhile, the ECM 114 may set actuator values for fast actuators to values that, given the slow actuator values, cause the engine system 100 to produce the immediate torque request instead of the predicted torque request.

The fast actuator values therefore cause the engine system 100 to produce the immediate torque request. When the ECM 114 decides to transition the axle torque from the immediate torque request to the predicted torque request, the ECM 114 changes the actuator values for one or more fast actuators to values that correspond to the predicted torque request. Because the slow actuator values have already been set based on the predicted torque request, the engine system 100 is able to produce the predicted torque request after only the delay imposed by the fast actuators. In other words, the longer delay that would otherwise result from changing axle torque using slow actuators is avoided.

For example only, when the predicted torque request is equal to the driver torque request, a torque reserve may be created when the immediate torque request is less than the driver torque request due to a temporary torque reduction request. Alternatively, a torque reserve may be created by increasing the predicted torque request above the driver torque request while maintaining the immediate torque request at the driver torque request. The resulting torque reserve can absorb sudden increases in required axle torque. For example only, sudden loads from an air conditioner or a power steering pump may be counterbalanced by increasing the immediate torque request. If the increase in immediate torque request is less than the torque reserve, the increase can be quickly produced by using fast actuators. The predicted torque request may then also be increased to re-establish the previous torque reserve.

Another example use of a torque reserve is to reduce fluctuations in slow actuator values. Because of their relatively slow speed, varying slow actuator values may produce control instability. In addition, slow actuators may include mechanical parts, which may draw more power and/or wear more quickly when moved frequently. Creating a sufficient torque reserve allows changes in desired torque to be made by varying fast actuators via the immediate torque request while maintaining the values of the slow actuators. For example, to maintain a given idle speed, the immediate torque request may vary within a range. If the predicted torque request is set to a level above this range, variations in the immediate torque request that maintain the idle speed can be made using fast actuators without the need to adjust slow actuators.

For example only, in a spark-ignition engine, spark timing may be a fast actuator value, while throttle opening area may be a slow actuator value. Spark-ignition engines may combust fuels including, for example, gasoline and ethanol, by applying a spark. By contrast, in a compression-ignition engine, fuel flow may be a fast actuator value, while boost pressure and EGR valve opening area may be slow actuator values.

When the engine 102 is a spark-ignition engine, the spark actuator module 126 may be a fast actuator and the throttle actuator module 116 may be a slow actuator. After receiving a new actuator value, the spark actuator module 126 may be able to change spark timing for the following firing event. When the spark timing (also called spark advance) for a firing event is set to a calibrated value, maximum torque is produced in the combustion stroke immediately following the firing event. However, a spark advance deviating from the calibrated value may reduce the amount of torque produced in the combustion stroke. Therefore, the spark actuator module 126 may be able to vary engine output torque as soon as the next firing event occurs by varying spark advance. For example only, a table of spark advances corresponding to different engine operating conditions may be determined during a calibration phase of vehicle design, and the calibrated value is selected from the table based on current engine operating conditions.

By contrast, changes in throttle opening area take longer to affect engine output torque. The throttle actuator module 116 changes the throttle opening area by adjusting the angle of the blade of the throttle valve 112. Therefore, once a new actuator value is received, there is a mechanical delay as the throttle valve 112 moves from its previous position to a new position based on the new actuator value. In addition, air flow changes based on the throttle valve opening are subject to air transport delays in the intake manifold 110. Further, increased air flow in the intake manifold 110 is not realized as an increase in engine output torque until the cylinder 118 receives additional air in the next intake stroke, compresses the additional air, and commences the combustion stroke.

Using these actuators as an example, a torque reserve can be created by setting the throttle opening area to a value that would allow the engine 102 to produce a predicted torque request. Meanwhile, the spark timing can be set based on an immediate torque request that is less than the predicted torque request. Although the throttle opening area generates enough air flow for the engine 102 to produce the predicted torque request, the spark timing is retarded (which reduces torque) based on the immediate torque request. The engine output torque will therefore be equal to the immediate torque request.

When additional torque is needed, such as when the air conditioning compressor is started, or when traction control determines wheel slip has ended, the spark timing can be set based on the predicted torque request. By the following firing event, the spark actuator module 126 may return the spark advance to a calibrated value, which allows the engine 102 to produce the full engine output torque achievable with the air flow already present. The engine output torque may therefore be quickly increased to the predicted torque request without experiencing delays from changing the throttle opening area.

When the engine 102 is a compression-ignition engine, the fuel actuator module 124 may be a fast actuator and the throttle actuator module 116 and the boost actuator module 164 may be emissions actuators. In this manner, the fuel mass may be set based on the immediate torque request, and the throttle opening area and boost may be set based on the predicted torque request. The throttle opening area may generate more air flow than necessary to satisfy the predicted torque request. In turn, the air flow generated may be more than required for complete combustion of the injected fuel such that the air/fuel ratio is usually lean and changes in air flow do not affect the engine torque output. The engine output torque will therefore be equal to the immediate torque request and may be increased or decreased by adjusting the fuel flow.

The throttle actuator module 116, the boost actuator module 164, and the EGR actuator module 172 may be controlled based on the predicted torque request to control emissions and to minimize turbo lag. The throttle actuator module 116 may create a vacuum to draw exhaust gases through the EGR valve 170 and into the intake manifold 110.

The axle torque arbitration module 204 may output the predicted torque request and the immediate torque request to a propulsion torque arbitration module 206. In various implementations, the axle torque arbitration module 204 may output the predicted and immediate torque requests to a hybrid optimization module 208. The hybrid optimization module 208 determines how much torque should be produced by the engine 102 and how much torque should be produced by the electric motor 198. The hybrid optimization module 208 then outputs modified predicted and immediate torque requests to the propulsion torque arbitration module 206. In various implementations, the hybrid optimization module 208 may be implemented in the hybrid control module 196.

The predicted and immediate torque requests received by the propulsion torque arbitration module 206 are converted from an axle torque domain (torque at the wheels) into a propulsion torque domain (torque at the crankshaft). This conversion may occur before, after, as part of, or in place of the hybrid optimization module 208.

The propulsion torque arbitration module 206 arbitrates between propulsion torque requests, including the converted predicted and immediate torque requests. The propulsion torque arbitration module 206 generates an arbitrated predicted torque request and an arbitrated immediate torque request. The arbitrated torques may be generated by selecting a winning request from among received requests. Alternatively or additionally, the arbitrated torques may be generated by modifying one of the received requests based on another one or more of the received requests.

Other propulsion torque requests may include torque reductions for engine over-speed protection, torque increases for stall prevention, and torque reductions requested by the transmission control module 194 to accommodate gear shifts. Propulsion torque requests may also result from clutch fuel cutoff, which reduces the engine output torque when the driver depresses the clutch pedal in a manual transmission vehicle to prevent a flare (rapid rise) in engine speed.

Propulsion torque requests may also include an engine shutoff request, which may be initiated when a critical fault is detected. For example only, critical faults may include detection of vehicle theft, a stuck starter motor, electronic throttle control problems, and unexpected torque increases. In various implementations, when an engine shutoff request is present, arbitration selects the engine shutoff request as the winning request. When the engine shutoff request is present, the propulsion torque arbitration module 206 may output zero as the arbitrated torques.

In various implementations, an engine shutoff request may simply shut down the engine 102 separately from the arbitration process. The propulsion torque arbitration module 206 may still receive the engine shutoff request so that, for example, appropriate data can be fed back to other torque requestors. For example, all other torque requestors may be informed that they have lost arbitration.

An RPM control module 210 may also output predicted and immediate torque requests to the propulsion torque arbitration module 206. The torque requests from the RPM control module 210 may prevail in arbitration when the ECM 114 is in an RPM mode. RPM mode may be selected when the driver removes their foot from the accelerator pedal, such as when the vehicle is idling or coasting down from a higher speed. Alternatively or additionally, RPM mode may be selected when the predicted torque request from the axle torque arbitration module 204 is less than a predetermined torque value.

The RPM control module 210 receives a desired RPM from an RPM trajectory module 212, and controls the predicted and immediate torque requests to reduce the difference between the desired RPM and the current RPM. For example only, the RPM trajectory module 212 may output a linearly decreasing desired RPM for vehicle coastdown until an idle RPM is reached. The RPM trajectory module 212 may then continue outputting the idle RPM as the desired RPM.

A torque reserve module 220 receives the arbitrated predicted and immediate torque requests from the propulsion torque arbitration module 206. The torque reserve module 220 may adjust the arbitrated predicted and immediate torque requests to create a torque reserve and/or to compensate for one or more loads. The torque reserve module 220 then outputs the adjusted predicted and immediate torque requests to an actuator control module 224.

For example only, a catalyst light-off process or a cold start emissions reduction process may require retarded spark advance. The torque reserve module 220 may therefore increase the adjusted predicted torque request above the adjusted immediate torque request to create retarded spark for the cold start emissions reduction process. In another example, the air/fuel ratio of the engine and/or the mass air flow may be directly varied, such as by diagnostic intrusive equivalence ratio testing and/or new engine purging. Before beginning these processes, a torque reserve may be created or increased to quickly offset decreases in engine output torque that result from leaning the air/fuel mixture during these processes.

The torque reserve module 220 may also create or increase a torque reserve in anticipation of a future load, such as power steering pump operation or engagement of an air conditioning (A/C) compressor clutch. The reserve for engagement of the A/C compressor clutch may be created when the driver first requests air conditioning. The torque reserve module 220 may increase the adjusted predicted torque request while leaving the adjusted immediate torque request unchanged to produce the torque reserve. Then, when the A/C compressor clutch engages, the torque reserve module 220 may increase the immediate torque request by the estimated load of the A/C compressor clutch.

The actuator control module 224 receives the adjusted predicted and immediate torque requests from the torque reserve module 220. The actuator control module 224 determines how the adjusted predicted and immediate torque requests will be achieved. The actuator control module 224 may control slow engine actuators based on the adjusted predicted torque request and control fast engine actuators based on the adjusted immediate torque request. The actuator control module 224 may be engine type specific. For example, the actuator control module 224 may be implemented differently or use different control schemes for spark-ignition engines versus compression-ignition engines.

In various implementations, the actuator control module 224 may define a boundary between modules that are common across all engine types and modules that are engine type specific. For example, engine types may include spark-ignition and compression-ignition. Modules prior to the actuator control module 224, such as the propulsion torque arbitration module 206, may be common across engine types, while the actuator control module 224 and subsequent modules may be engine type specific.

For example, in a spark-ignition engine, the actuator control module 224 may vary the opening of the throttle valve 112 as a slow actuator that allows for a wide range of torque control. In addition the actuator control module 224 may use spark timing as a fast actuator. However, spark timing may not provide as much range of torque control. Furthermore, the amount of torque control possible with changes in spark timing (referred to as spark reserve capacity) may vary as air flow changes.

In various implementations, the actuator control module 224 may generate an air torque request based on the adjusted predicted torque request. The air torque request may be equal to the adjusted predicted torque request, setting air flow so that the adjusted predicted torque request can be achieved by changes to other actuators.

An air control module 228 may determine desired actuator values based on the air torque request. For example, the air control module 228 may control desired manifold absolute pressure (MAP), desired throttle area, and/or desired air per cylinder (APC). Desired MAP may be used to determine desired boost, and desired APC may be used to determine a desired amount of opening of the EGR valve 170.

The actuator control module 224 may also generate a spark torque request and a fuel torque request. The spark torque request may be used by a spark control module 232 to determine how much to retard the spark timing (which reduces engine output torque) from a calibrated spark advance.

The fuel control module 240 may vary the amount of fuel provided to each cylinder based on the fuel torque request from the actuator control module 224. During normal operation of a spark-ignition engine, the fuel control module 240 may operate in an air lead mode in which the fuel control module 240 attempts to maintain a stoichiometric air/fuel ratio by controlling fuel flow based on air flow. The fuel control module 240 may determine a fuel mass that will yield stoichiometric combustion when combined with the current amount of air per cylinder. The fuel control module 240 may instruct the fuel actuator module 124 via the fueling rate to inject this fuel mass for each activated cylinder.

In compression-ignition systems, the fuel control module 240 may operate in a fuel lead mode in which the fuel control module 240 determines a fuel mass for each cylinder that satisfies the fuel torque request while minimizing emissions, noise, and fuel consumption. In the fuel lead mode, air flow is controlled based on fuel flow and may be controlled to yield a lean air/fuel ratio. In addition, the air/fuel ratio may be maintained above a predetermined level, which may prevent black smoke production in dynamic engine operating conditions.

A torque estimation module 244 may estimate torque output of the engine 102. This estimated torque may be used by the air control module 228 to perform closed-loop control of engine air flow parameters, such as throttle area, MAP, and EGR valve opening area. For example, a torque relationship such as $$T=f(\mathrm{APC},S,\mathrm{EGR},\mathrm{AF},\mathrm{OT},\#) \quad (1)$$

may be defined, where torque (T) is a function of air per cylinder (APC), spark advance (S), EGR valve opening area (EGR), air/fuel ratio (AF), oil temperature (OT), and number of activated cylinders (#).

This relationship may be modeled by an equation and/or may be stored as a lookup table. The torque estimation module 244 may determine APC based on measured MAF and current RPM, thereby allowing closed loop air control based on actual air flow.

The actual spark advance may be used to estimate the actual engine output torque. When a calibrated spark advance value is used to estimate torque, the estimated torque may be called an estimated air torque, or simply air torque. The air torque is an estimate of how much torque the engine could generate at the current air flow if spark retard was removed (i.e., spark timing was set to the calibrated spark advance value) and all cylinders were fueled.

The air control module 228 may output a desired area signal to the throttle actuator module 116. The throttle actuator module 116 then regulates the throttle valve 112 to produce the desired throttle area. The air control module 228 may generate the desired area signal based on an inverse torque model and the air torque request. The air control module 228 may use the estimated air torque and/or the MAF signal in order to perform closed loop control. For example, the desired area signal may be controlled to minimize a difference between the estimated air torque and the air torque request.

The air control module 228 may output a desired manifold absolute pressure (MAP) signal to a boost scheduling module 248. The boost scheduling module 248 uses the desired MAP signal to control the boost actuator module 164. The boost actuator module 164 then controls one or more turbochargers (e.g., the turbocharger including the turbine 160-1 and the compressor 160-2) and/or superchargers.

The air control module 228 may also output a desired air per cylinder (APC) signal to an EGR scheduling module 252. Based on the desired APC signal and the RPM signal, the EGR scheduling module 252 may control the position of the EGR valve 170 using the EGR actuator module 172.

Referring back to the spark control module 232, calibrated spark advance values may vary based on various engine operating conditions. For example only, a torque relationship may be inverted to solve for desired spark advance. For a given torque request ($T_{des}$), the desired spark advance ($S_{des}$) may be determined based on $$S_{des}=f^{-1}(T_{des},\mathrm{APC},\mathrm{EGR},\mathrm{AF},\mathrm{OT},\#). \quad (2)$$

This relationship may be embodied as an equation and/or as a lookup table. The air/fuel ratio (AF) may be the actual air/fuel ratio, as reported by the fuel control module 240.

When the spark advance is set to the calibrated spark advance, the resulting torque may be as close to mean best torque (MBT) as possible. MBT refers to the maximum engine output torque that is generated for a given air flow as spark advance is increased, while using fuel having an octane rating greater than a predetermined threshold and using stoichiometric fueling. The spark advance at which this maximum torque occurs is referred to as MBT spark. The calibrated spark advance may differ slightly from MBT spark because of, for example, fuel quality (such as when lower octane fuel is used) and environmental factors. The torque at the calibrated spark advance may therefore be less than MBT.

A pump control module 254 sends a signal to the pump actuator module 146 to switch the water pump 140 on or off. The pump control module 254 may switch the water pump 140 on to cool the engine 102. The pump control module 254 may switch the water pump 140 off to reduce the time required to warm the engine 102 at startup and/or to improve fuel economy. The torque reserve module 220 may determine the amount of load on the engine 102 and output the engine load to the pump control module 254. The pump control module 254 may switch the water pump 140 on or off based on the amount of the engine load and/or the duration of the engine load.

The pump control module 254 sends a signal to the torque reserve module 220 indicating when the water pump 140 is about to be switched on or off. In response, the torque reserve module 220 adjusts the torque reserve before the water pump 140 is switched on or off based on a change in engine load expected when the water pump 140 is switched on or off. This allows the actuator control module 224 to adjust fast engine actuators when the water pump 140 is switched on or off to compensate for the resulting change in engine load and thereby prevent an abrupt change in engine speed.

Figure 3:
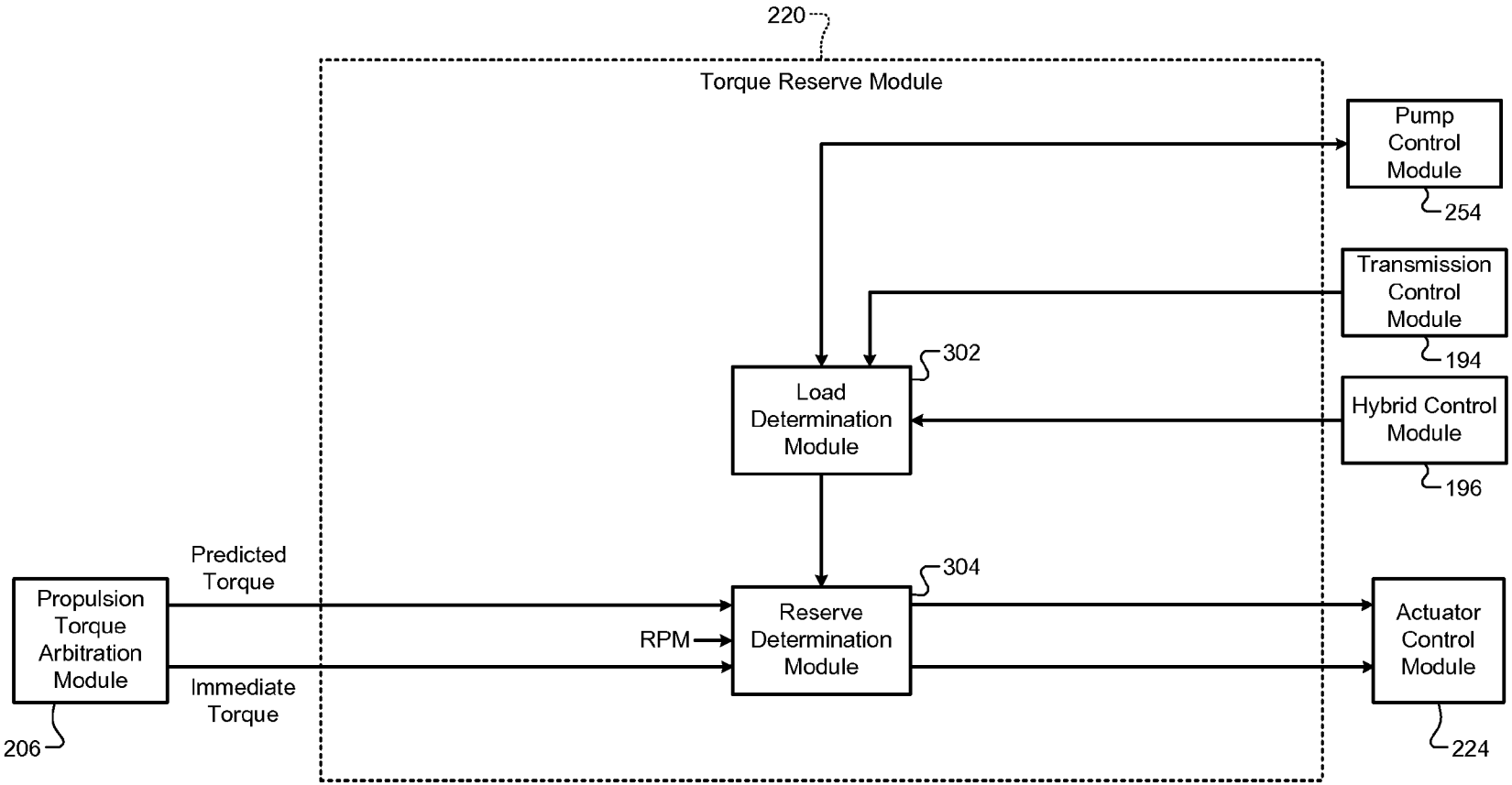

Referring now to FIG. 3, an example implementation of the torque reserve module 220 includes a load determination module 302 and a reserve determination module 304. The load determination module 302 determines the amount of load on the engine 102. The engine load may include a transmission load, a generator load, and/or an accessory belt load (e.g., an alternator load, a pump load). The load determination module 302 may determine the transmission load based on an input received from the transmission control module 194. The load determination module 302 may determine the generator load based on an input received from the hybrid control module 196. The load determination module 302 may determine the accessory belt load based on an input received from the pump control module 254.

The load determination module 302 may determine a change in the engine load expected when the water pump 140 is switched on or off. The load determination module 302 may determine an increase in the engine load expected when the water pump 140 is switched on. The engine load increase may be due to a pump load associated with engaging the clutch of the water pump 140 and an alternator load associated with activating the clutch. The load determination module 302 may determine a decrease in the engine load expected when the water pump 140 is switched off. The engine load decrease may be due to a loss of the pump load associated with disengaging the water pump clutch.

The reserve determination module 304 determines the amount of torque reserve, if any, to create by adjusting the predicted and immediate torque requests. The reserve determination module 304 may adjust the torque reserve before the water pump 140 is switched on or off. The reserve determination module 304 may increase the torque reserve before the water pump 140 is switched on. Then, when the water pump 140 is switched on, the reserve determination module 304 may increase the immediate torque request to the predicted torque request. Since the slow engine actuators are already adjusted based on the predicted torque request, increasing the immediate torque request to the predicted torque request only affects the fast engine actuators. Thus, the torque output of the engine 102 may be increased with minimal delay to match the engine load increase due to switching the water pump 140 on.

The reserve determination module 304 may decrease the torque reserve before the water pump 140 is switched off. Then, when the water pump 140 is switched off, the reserve determination module 304 may decrease the immediate torque request to compensate for the resulting decrease in engine load using the fast engine actuators.

The reserve determination module 304 may determine the amount by which the torque reserve is adjusted based on engine speed and/or the engine load change expected when the water pump 140 is switched on or off. Before the water pump 140 is switched on, the reserve determination module 304 may increase the torque reserve by an amount that is greater than or equal to the expected increase in engine load. Before the water pump 140 is switched off, the reserve determination module 304 may decrease the torque reserve while maintaining a sufficient amount of torque reserve to compensate for the expected decrease in engine load.

As the engine speed increases, the ECM 114 may compensate for changes in engine load using slow engine actuators without causing a delay in the torque response of the engine 102. Thus, as the engine speed increases, the reserve determination module 304 may increase the torque reserve by a lesser amount before the water pump 140 is switched on. Conversely, as the engine speed decreases, the reserve determination module 304 may increase the amount by a greater amount before the water pump 140 is switched on.

The reserve determination module 304 may determine the timing of the torque reserve adjustment based on the engine speed and the timing of the engine load change expected when the water pump 140 is switched on or off. The torque reserve may be adjusted at a first time and the engine load may change at a second time. The reserve determination module 304 may adjust the first time to adjust a period between the first time and the second time. The reserve determination module 304 may decrease the period as the engine speed increases. The reserve determination module 304 may increase the period as the engine speed decreases. For example only, the period may be within a predetermined range between 0 milliseconds (ms) and 750 ms.

Figure 4:
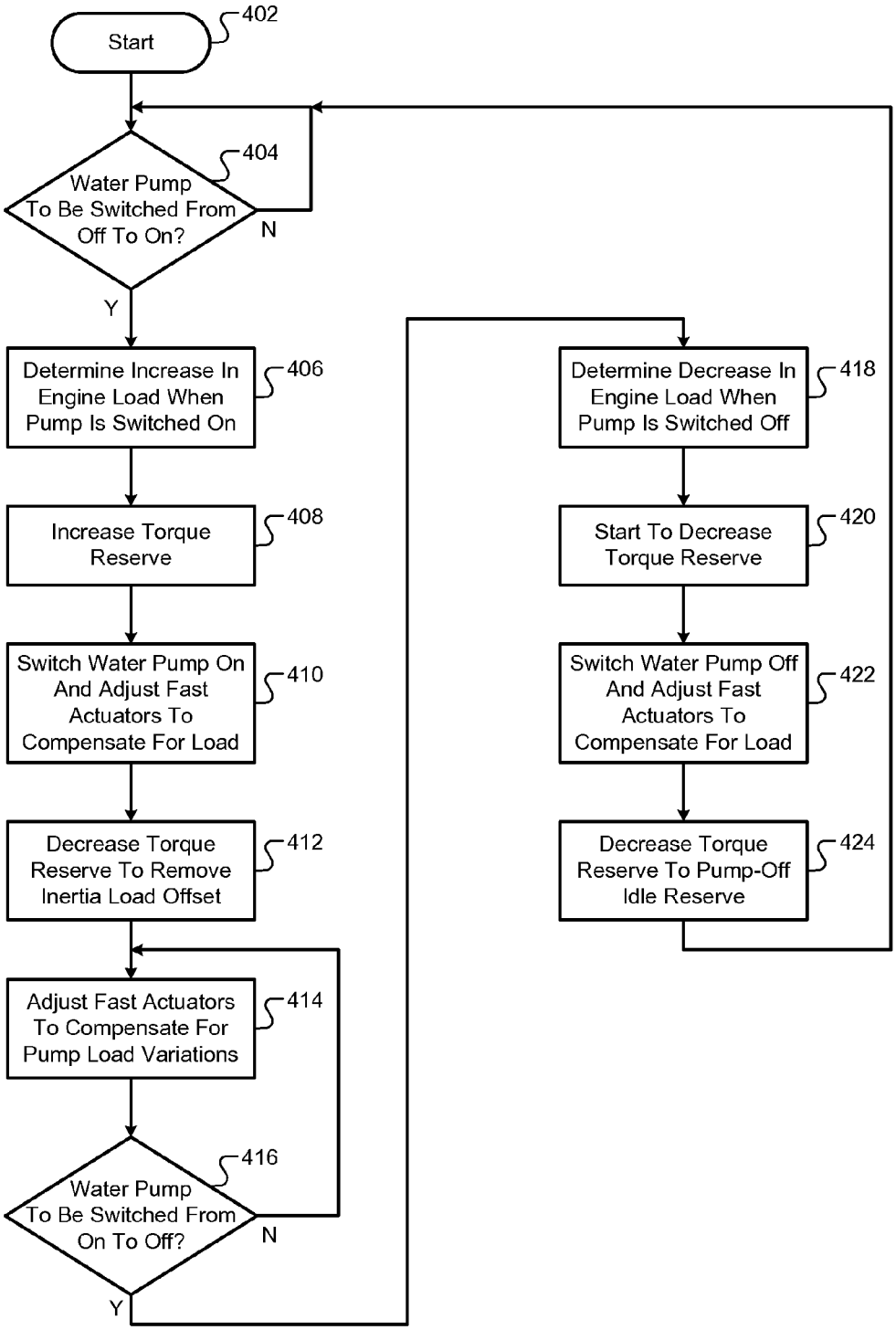
FIG. 4 is a flowchart illustrating an example control method according to the principles of the present disclosure.

Referring now to FIG. 4, an example method for controlling the torque output of an engine to compensate for changes in engine load when a water pump coupled to the engine is switched on or off begins at 402. At 404, the method determines whether the water pump is about to be switched from off to on. If the water pump is about to be switched from off to on, the method continues at 406.

At 406, the method determines an amount by which the engine load is expected to increase when the water pump is switched from off to on. The method may determine this amount based on a pump load associated with engaging a clutch of the water pump and an alternator load associated with activating the clutch. The pump load may include a steady-state load and a transient load. The transient load is a temporary load spike that occurs when the clutch is initially engaged. The steady-state load is the load that remains after the clutch is engaged and the transient load decreases to zero.

At 408, the method increases the torque reserve by a first amount. The method may determine the first amount based on the expected engine load increase and engine speed. As the engine speed increases, the method may use slow engine actuators to compensate for changes in engine load, instead of or in addition to using fast engine actuators, without causing a delay in the torque response of the engine. Thus, the first amount may be inversely related to the engine speed.

At 410, the method switches the water pump on and adjusts fast engine actuators to compensate for the resulting increase in engine load. At 412, the method decreases the torque reserve to remove the portion of the torque reserve added to offset the transient load associated with engaging the clutch of the water pump. The method may decrease the torque reserve to an idle reserve that is sufficient to enable use of the fast engine actuators to counteract variations in the pump load as well as variations in other engine idle loads such as air/conditioning (A/C) pump loads.

At 414, the method adjusts the fast engine actuators to compensate for variations in the pump load while the engine is idling. At 416, the method determines whether the water pump is about to be switched from on to off. If the water pump is about to be switched from on to off, the method continues at 418. Otherwise, the method continues at 414.

At 418, the method determines an amount by which the engine load is expected to decrease when the water pump is switched from on to off. The method may assume that the transient portion of the pump load is already removed when the water pump is switched from on to off. Thus, the method may determine the expected decrease in engine load based on the steady-state portion of the pump load.

At 420, the method starts to decrease the torque reserve. The method may decrease the torque reserve while maintaining a sufficient amount of torque reserve to compensate for the decrease in engine load expected when the water pump is switched off. At 422, the method switches the water pump off and adjusts fast engine actuators to compensate for the resulting decrease in engine load.

At 424, the method decreases the torque reserve to remove the portion of the torque reserve added to offset variations in the pump load. The method may decrease the torque reserve to an idle reserve that is sufficient to enable use of the fast engine actuators to counteract variations in engine idle loads other than the pump load.

Figure 5:
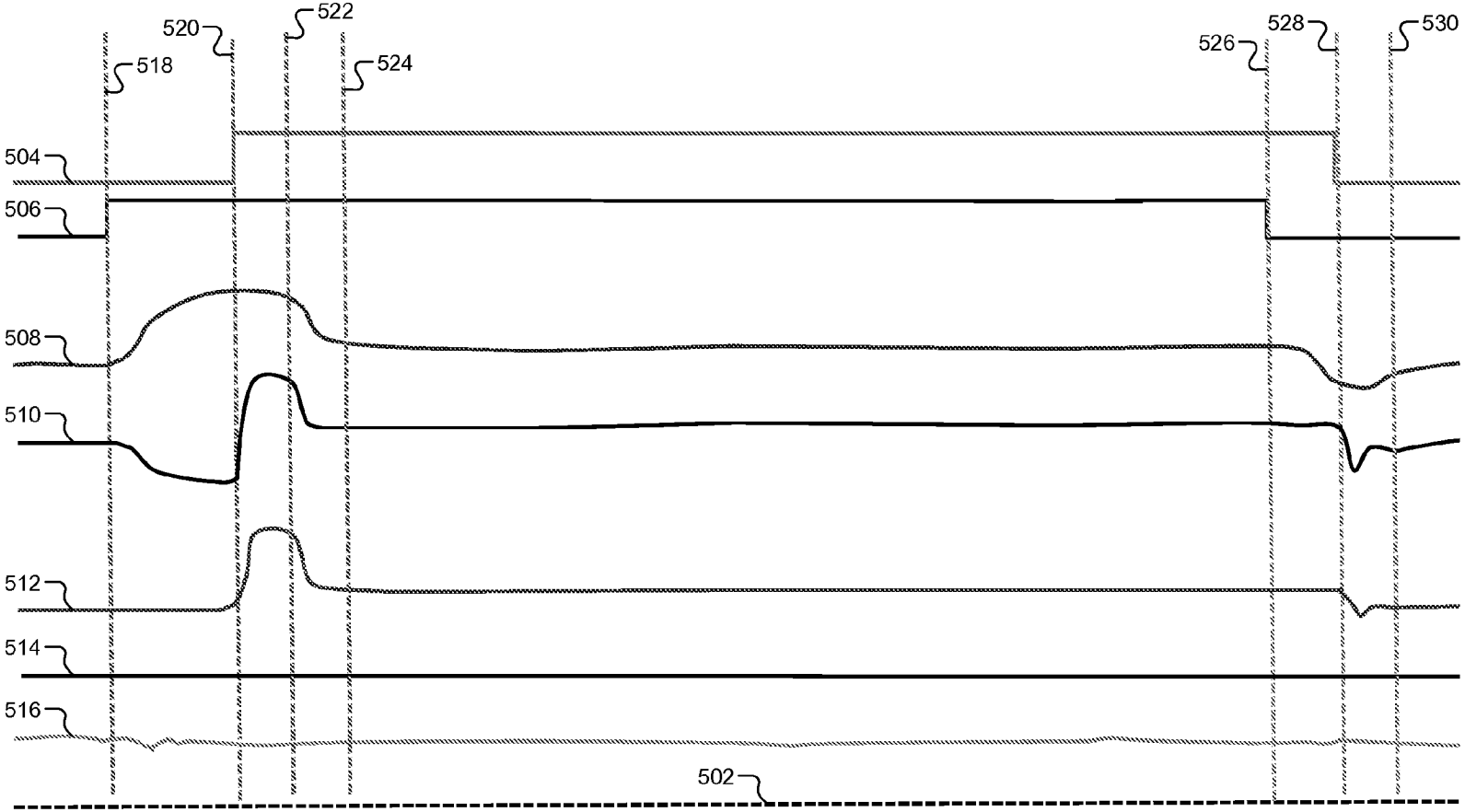
FIG. 5 is a graph illustrating example control signals and example sensor signals according to the principles of the present disclosure.

Referring now to FIG. 5, example control signals and example sensor signals according to the principles of the present disclosure are illustrated. The control signals and the sensor signals are plotted with respect to an x-axis 502. The x-axis 502 represents time.

The control signals include a pump activation signal 504, an activation indicator signal 506, a throttle control signal 508, and a spark control signal 510. The pump activation signal 504 activates and deactivates the water pump. The activation indicator signal 506 indicates when the water pump is about to be switched on or off.

The throttle control signal 508 controls an opening area of a throttle valve of the engine. The spark control signal 510 controls spark timing of the engine. Throttle area may be a slow actuator value and spark timing is may be fast actuator value.

The sensor signals include an indicated torque signal 512, a flywheel torque signal 514, and an RPM signal 516. The indicated torque signal 512 indicates the amount of torque output by the engine. The flywheel torque signal 514 indicates the amount of torque output by the engine at, for example, a flywheel of the engine, after subtracting the amount of load on the engine. The RPM signal 516 indicates engine speed in revolutions per minute. Although referred to as sensor signals, one or more of the sensor signals may be generated based on estimations rather than measurements.

At 518, the activation indicator signal 506 increases, indicating that the water pump is about to be switched from off to on. In response, between 518 and 520, a torque reserve is increased or ramped up by increasing the throttle control signal 508 to increase the throttle area and by decreasing the spark control signal 510 to retard the spark timing. The amount of torque reserve created may be equal to a transient load that includes a pump load associated with engaging a clutch of the water pump and an alternator load associated with activating the clutch. The timing of the torque reserve increase may be based on actuator response times. In one example, the period between 518 and 520 may be between 0 ms and 750 ms.

At 520, the pump activation signal 504 is increased to switch the water pump on. Between 520 and 522, the spark control signal 510 is increased to advance the spark timing and thereby increase the torque output of the engine. The torque output of the engine is increased to match the magnitude and timing of the engine load increase associated with switching the water pump on. This prevents an abrupt decrease, or sag, in the engine speed as indicated by the RPM signal 516.

Between 522 and 524, the torque reserve is decreased to an idle reserve to improve fuel economy. The idle reserve may be sufficient to counteract variations in the pump load as well as variations in other engine idle loads such as an A/C pump load. As the torque reserve is decreased to the idle reserve, the portion of the torque reserve added to counteract the transient load associated with switching the water pump on may be removed. The period between 520 and 524 may be between 0 ms and 750 ms.

Between 526 and 528, the activation indicator signal 506 decreases, indicating that the water pump is about to be switched from on to off. In response, a decrease or ramp down of the torque reserve is started by decreasing the throttle control signal 508 to decrease the throttle area. A sufficient amount of torque reserve may be maintained to compensate for the decrease in engine load expected when the water pump is switched off. The period between 526 and 528 may be between 0 ms and 750 ms.

At 528, the pump activation signal 504 is increased to switch the water pump off. Between 528 and 530, the spark control signal 510 is decreased to retard the spark timing and thereby decrease the torque output of the engine. The torque output of the engine is decreased to match the magnitude and timing of the engine load decrease associated with switching the water pump off. This prevents an abrupt increase, or flare, in the engine speed as indicated by the RPM signal 516. The period between 528 and 530 may be between 0 ms and 750 ms.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A system comprising:

a pump control module that switches a water pump between on and off, wherein the water pump circulates coolant through an engine when the water pump is on;

an actuator control module that controls a first actuator of the engine based on a first torque request and that controls a second actuator of the engine based on a second torque request; and a torque reserve module that adjusts a torque reserve before the water pump is switched on or off based on a change in engine load expected when the water pump is switched on or off, wherein:

the torque reserve is a difference between the first torque request and the second torque request;

the torque reserve module decreases the torque reserve after the water pump is switched on;

the torque reserve module further decreases the torque reserve before the water pump is switched off; and the actuator control module adjusts the second actuator to prevent an increase in engine speed when the water pump is switched off.

2. The system of claim 1 wherein the torque reserve module increases the torque reserve before the water pump is switched on and the actuator control module adjusts the second actuator to prevent a decrease in engine speed when the water pump switched on.

3. The system of claim 1 wherein the torque reserve module adjusts the torque reserve at a first time and the pump control module switches the water pump on or off at a second time that is after the first time.

4. The system of claim 3 further comprising a reserve determination module that determines a period between the first time and the second time based on engine speed.

5. The system of claim 1 further comprising a load determination module that determines the engine load change based on a pump load associated with engaging a clutch of the water pump and an alternator load associated with activating the clutch.

6. The system of claim 5 wherein the actuator control module adjusts the second actuator to compensate for variations in the pump load when the water pump is on.

7. The system of claim 1 further comprising a reserve determination module that determines an amount by which the torque reserve is adjusted based on the engine load change and engine speed.

8. The system of claim 1 wherein the first actuator includes a throttle valve and the second actuator includes a spark plug.

9. The system of claim 1 wherein the first actuator includes at least one of boost device and exhaust gas recirculation (EGR) valve and the second actuator includes a fuel injector.

10. A method comprising:

switching a water pump between on and off, wherein the water pump circulates coolant through an engine when the water pump is on;

controlling a first actuator of the engine based on a first torque request and that controls a second actuator of the engine based on a second torque request;

adjusting a torque reserve before the water pump is switched on or off based on a change in engine load expected when the water pump is switched on or off, wherein the torque reserve is a difference between the first torque request and the second torque request;

decreasing the torque reserve after the water pump is switched on;

further decreasing the torque reserve before the water pump is switched off; and adjusting the second actuator to prevent an increase in engine speed when the water pump is switched off.

11. The method of claim 10 further comprising increasing the torque reserve before the water pump is switched on and adjusting the second actuator to prevent a decrease in engine speed when the water pump switched on.

12. The method of claim 10 further comprising adjusting the torque reserve at a first time and switching the water pump on or off at a second time that is after the first time.

13. The method of claim 12 further comprising determining a period between the first time and the second time based on engine speed.

14. The method of claim 10 further comprising determining the engine load change based on a pump load associated with engaging a clutch of the water pump and an alternator load associated with activating the clutch.

15. The method of claim 13 further comprising adjusting the second actuator to compensate for variations in the pump load when the water pump is on.

16. The method of claim 10 further comprising determining an amount by which the torque reserve is adjusted based on the engine load change and engine speed.

17. The method of claim 10 wherein the first actuator includes a throttle valve and the second actuator includes a spark plug.

18. The method of claim 10 wherein the first actuator includes at least one of boost device and exhaust gas recirculation (EGR) valve and the second actuator includes a fuel injector.

19. A method comprising:

switching a water pump between on and off, wherein the water pump circulates coolant through an engine when the water pump is on;

controlling a first actuator of the engine based on a first torque request and that controls a second actuator of the engine based on a second torque request;

decreasing a torque reserve after the water pump is switched on; and further decreasing the torque reserve before the water pump is switched off based on a change in engine load expected when the water pump is switched off, wherein the torque reserve is a difference between the first torque request and the second torque request.

20. The method of claim 19 further comprising:

decreasing the torque reserve before the water pump is switched off; and adjusting one of the first and second actuators to prevent an increase in engine speed when the water pump is switched off.

* * * * *